US012571173B1

(12) United States Patent
Brown, Jr.

(10) Patent No.: US 12,571,173 B1
(45) Date of Patent: Mar. 10, 2026

(54) MANUALLY OPERATED PIVOTING SECURITY BOLLARDS KIT WITH COUNTERWEIGHTS

(71) Applicant: K12 Defense Consultants, L.L.C., Mesa, AZ (US)

(72) Inventor: Charles Lee Brown, Jr., Mesa, AZ (US)

(73) Assignee: K12 Defense Consultants, L.L.C., Mesa, AZ (US)

( * ) Notice: Subject to any disclaimer, the term of this patent is extended or adjusted under 35 U.S.C. 154(b) by 724 days.

(21) Appl. No.: 17/983,994

(22) Filed: Nov. 9, 2022

Related U.S. Application Data

(60) Provisional application No. 63/277,518, filed on Nov. 9, 2021.

(51) Int. Cl.
*E01F 13/08* (2006.01)

(52) U.S. Cl.
CPC ..... *E01F 13/08* (2013.01)

(58) Field of Classification Search
CPC ..... E01C 13/04; E01C 13/06; E01C 13/08
See application file for complete search history.

(56) References Cited

U.S. PATENT DOCUMENTS 653,128 A * 7/1900 Adams ..... B61L 29/026 256/15
682,135 A * 9/1901 Conway ..... B61L 29/026 49/134
709,105 A * 9/1902 Miller ..... B61L 29/026 256/15
716,500 A * 12/1902 Washburn ..... B61L 29/026 49/134
1,094,834 A * 4/1914 Brixen ..... E01F 13/08 49/134

(Continued)

FOREIGN PATENT DOCUMENTS

DE 10108586 A1 * 9/2002 ..... E01F 13/08
GB 2348228 A * 9/2000 ..... E01F 13/08

(Continued)

OTHER PUBLICATIONS

Jackwin Private K-Shape Parking Lock Parking Space Car Parking Barrier.

*Primary Examiner* — Gary S Hartmann
(74) *Attorney, Agent, or Firm* — Kenneth C. Booth; Booth Udall, PLC

(57) ABSTRACT

A security bollard system with a housing and at least one bollard assembly. The housing has an interior and a top surface with an opening through the top surface into the interior. The bollard assembly is positioned within the housing and includes a bollard. The bollard is rotatably coupled to the interior of the housing and is rotatable between a lowered position and a raised position. When in the lowered position, the bollard is positioned in the interior of the housing and when in the raised position, the bollard extends up through the opening in the top surface of the housing. Each bollard is configured to be moved between the lowered positioned and the raised position manually. Additionally, each bollard has a pivot point about which the bollard rotates that is positioned to balance the bollard about the pivot point and limit torque required to rotate the bollard.

19 Claims, 10 Drawing Sheets

(56) References Cited

U.S. PATENT DOCUMENTS

| | | | | | |
|---|---|---|---|---|---|
| 1,194,832 | A | * | 8/1916 | Frechette | E01F 13/08 49/134 |
| 1,203,006 | A | * | 10/1916 | Keenan | E01F 13/08 49/82.1 |
| 4,035,955 | A | | 7/1977 | Burnett | |
| 4,576,509 | A | | 3/1986 | Beaty, Sr. | |
| 4,624,600 | A | | 11/1986 | Wagner et al. | |
| 4,705,426 | A | | 11/1987 | Perea | |
| 4,998,843 | A | * | 3/1991 | Mothe | E01F 13/08 404/11 |
| 5,146,710 | A | * | 9/1992 | Caldwell | E01F 13/08 49/132 |
| 7,118,304 | B2 | | 10/2006 | Turpin et al. | |
| 7,484,905 | B2 | * | 2/2009 | Gelfand | E01F 13/12 404/9 |
| 8,979,419 | B2 | | 3/2015 | Heald | |
| 10,612,200 | B2 | | 4/2020 | Bock, II et al. | |
| 11,319,681 | B2 | * | 5/2022 | Herrera | E01F 13/123 |
| 11,873,610 | B2 | * | 1/2024 | Herrera | E01F 13/08 |
| 2006/0233609 | A1 | | 10/2006 | Gelfand et al. | |

FOREIGN PATENT DOCUMENTS

| | | | | | |
|---|---|---|---|---|---|
| GB | 2360808 | B | * | 1/2004 | E01F 13/08 |
| KR | 20200117803 | A | * | 10/2020 | E01F 13/08 |
| KR | 102224467 | B1 | * | 3/2021 | E01F 15/14 |

* cited by examiner

MANUALLY OPERATED PIVOTING SECURITY BOLLARDS KIT WITH COUNTERWEIGHTS

CROSS REFERENCE TO RELATED APPLICATIONS

This application claims the benefit of the filing date of U.S. Provisional Patent Application 63/277,518 entitled "MANUALLY OPERATED PIVOTING SECURITY BOLLARDS KIT WITH COUNTERWEIGHTS" to Charles Lee Brown, Jr. that was filed on Nov. 9, 2021, the disclosure of which is hereby incorporated herein by this reference.

TECHNICAL FIELD

Aspects of this document relate generally to security bollards, and more specifically to security bollards that are manually operated.

BACKGROUND

Security bollards are used around buildings and properties and are designed to impede large vehicles, which may be a threat to the property, from entering the property past the bollards while still allowing pedestrian traffic through. Sometimes bollards are used to prevent all vehicular traffic, sometimes they are designed to only temporarily prevent vehicular traffic, and at other times bollards may be removed or be lowered into the ground. The size and weight of a security bollard generally determines the effectiveness of the security bollard against a particular sized vehicle. Some are erected to restrict vehicles from driving in an area but act more as a visual barrier that would do damage to a vehicle trying to pass but would not stop the vehicle. Other security bollards are made very heavy and are reinforced to stop vehicles that may lose control or even those intentionally trying to break through the barrier that the security bollards create.

Because security bollards are sometimes needed even at a vehicular entrance to a property, often it is necessary to move the security bollards out of the way of the traffic to allow a vehicle to pass. Because the weight of the security bollards are generally commensurate with the level of security the security bollards can provide, this becomes a challenge. Many security bollards are configured with automatic operation features such as electrically, pneumatically or hydraulically operated motors to raise or lower the heavy bollards to restrict or allow traffic, respectively. Such configurations, although they may provide increased flexibility for certain areas, and can be easy to operate, also come with their own set of problems. When power is lost to the automatic security bollard controllers, they can no longer be moved. Installation requires electrical wiring, additional space for the motors and hydraulics or pneumatics, and maintenance becomes a greater concern because hydraulics and pneumatics tend to leak over time, causing environmental concerns as well.

SUMMARY

Aspects of this document relate to a security bollard system comprising a housing having an interior and a top surface with at least one opening through the top surface into the interior and at least one cover panel configured to cover the at least one opening, and at least two bollard assemblies positioned within the housing, each bollard assembly of the at least two bollard assemblies comprising a bollard rotatably coupled to the interior of the housing through a bearing, the bollard manually rotatable between a lowered position and a raised position, wherein when in the lowered position, the bollard is positioned in the interior of the housing and oriented parallel with the top surface of the housing and when in the raised position, the bollard extends up through the at least one opening perpendicular to the top surface of the housing, an upper stop positioned within the interior of the housing to contact the bollard when the bollard is in the raised position, a locking tab extending away from the bollard and having a locking aperture, the locking aperture configured to align with the upper stop when the bollard is in the raised position, and a locking pin configured to engage with the upper stop and the locking aperture to couple the locking tab to the upper stop and lock the bollard in the raised position, wherein each bollard has a pivot point about which the bollard rotates that is positioned to balance the bollard about the pivot point and limit a torque required to rotate the bollard about the pivot point, wherein each bollard of the at least two bollard assemblies rotates in a direction opposite from each adjacent bollard of the at least two bollard assemblies, wherein each bollard is configured to rotate about an axis extending in a first direction and impede vehicle motion in the first direction, and wherein each bollard is configured to be moved between the lowered position and the raised position manually.

Particular embodiments may comprise one or more of the following features. The security bollard system may further comprise at least one drain hole through a bottom of the housing, the at least one drain hole configured to drain fluid out of the housing. Each bollard assembly may further comprise a protrusion coupled to and extending away from the at least one cover panel and configured to hold the bollard in the lowered position when the at least one cover panel is positioned to cover the at least one opening.

Aspects of this document relate to a security bollard system comprising a housing having an interior and a top surface with at least one opening through the top surface into the interior, and at least one bollard assembly positioned within the housing, each bollard assembly of the at least one bollard assembly comprising a bollard rotatably coupled to the interior of the housing, the bollard rotatable between a lowered position and a raised position, wherein when in the lowered position, the bollard is positioned in the interior of the housing and when in the raised position, the bollard extends up through the at least one opening, an upper stop positioned within the interior of the housing to contact the bollard when the bollard is in the raised position, a locking tab extending away from the bollard, the locking tab configured to align with the upper stop when the bollard is in the raised position, and a locking pin configured to engage with the upper stop and the locking tab to couple the locking tab to the upper stop and lock the bollard in the raised position, wherein each bollard has a pivot point about which the bollard rotates that is positioned to balance the bollard about the pivot point, and wherein each bollard is configured to rotate about an axis extending in a first direction and impede vehicle motion in the first direction.

Particular embodiments may comprise one or more of the following features. The pivot point may be positioned to limit a torque required to rotate the bollard about the pivot point. Each bollard may be rotatably coupled to the interior of the housing through a bearing. When the bollard is in the lowered position, the bollard may be oriented parallel with the top surface of the housing and when the bollard is in the raised position, the bollard may be perpendicular to the top surface of the housing. The locking tab may have a locking aperture, wherein the locking pin is configured to engage with the upper stop and the locking aperture to lock the bollard in the raised position. Each bollard may be configured to be moved between the lowered position and the raised position manually. Each bollard of the at least one bollard assembly may rotate in a direction opposite from each adjacent bollard of the at least one bollard assembly. The security bollard system may further comprise at least one drain hole through a bottom of the housing, the at least one drain hole configured to drain fluid out of the housing.

Aspects of this document relate to a security bollard system comprising at least one bollard assembly, each bollard assembly of the at least one bollard assembly comprising a bollard rotatable between a lowered position and a raised position, wherein when in the lowered position, the bollard is oriented to allow a vehicle to pass over the security bollard system and when in the raised position, the bollard is oriented to impede the vehicle from passing over the security bollard system, wherein each bollard is configured to rotate about an axis extending in a first direction and impede vehicle motion in the first direction when the bollard is in the raised position.

Particular embodiments may comprise one or more of the following features. The security bollard system may further comprise a housing having an interior and a top surface with at least one opening through the top surface of the interior, wherein the at least one bollard assembly is positioned within the housing. When in the lowered position, each bollard may be positioned in the interior of the housing and when in the raised position, each bollard may extend up through the at least one opening. Each bollard assembly of the at least one bollard assembly may further comprise an upper stop positioned to contact the bollard when the bollard is in the raised position. Each bollard assembly of the at least one bollard assembly may further comprise a locking tab extending away from the bollard, the locking tab configured to align with the upper stop when the bollard is in the raised position, and a locking pin configured to engage with the upper stop and the locking tab to couple the locking tab to the upper stop and lock the bollard in the raised position. Each bollard may have a pivot point about which the bollard rotates that is positioned to balance the bollard about the pivot point. Each bollard may be configured to be moved between the lowered position and the raised position manually. Each bollard may have a pivot point about which the bollard rotates that is positioned to limit a torque required to rotate the bollard about the pivot point. Each bollard of the at least one bollard assembly may rotate in a direction opposite from each adjacent bollard of the at least one bollard assembly.

The foregoing and other aspects, features, applications, and advantages will be apparent to those of ordinary skill in the art from the specification, drawings, and the claims. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those of ordinary skill in the art from the specification, drawings, and the claims.

BRIEF DESCRIPTION OF THE DRAWINGS

Implementations will hereinafter be described in conjunction with the appended drawings, where like designations denote like elements, and.

Figure 1:
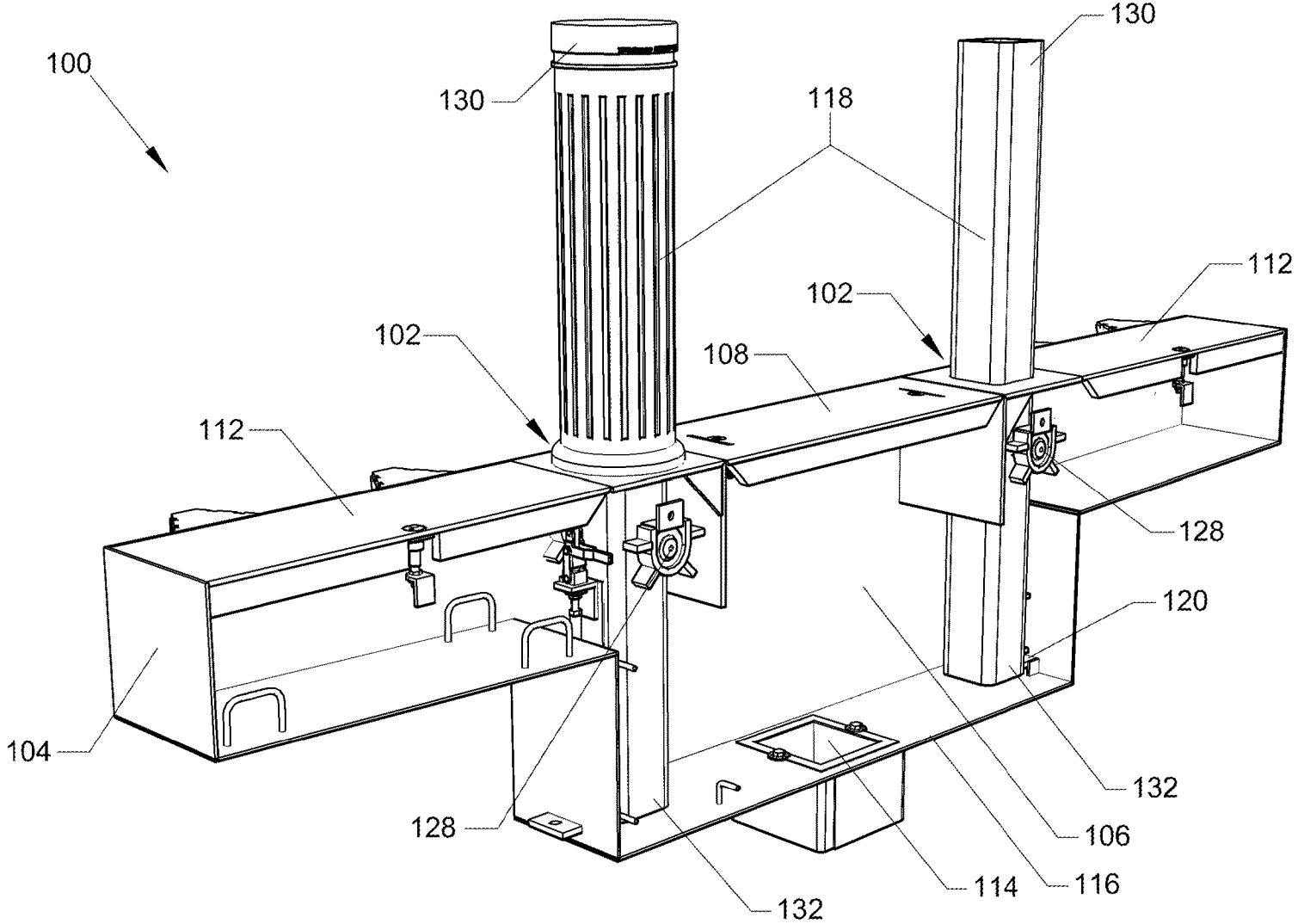
FIG. 1 is a perspective view of a security bollard system with a side of the housing removed to expose the interior of the housing and with the bollards in the raised position.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of implementations that are described in many different forms, there is shown in the drawings and will herein be described in detail particular implementations with the understanding that the present disclosure is to be considered as an exemplification of the principles of the disclosed methods and systems, and is not intended to limit the broad aspect of the disclosed concepts to the implementations illustrated.

In the following description, reference is made to the accompanying drawings which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure. As will become apparent, changes may be made in the function and/or arrangement of any of the elements described in the disclosed exemplary implementations without departing from the spirit and scope of this disclosure.

The present disclosure is related to a security bollard system 100 that is specifically designed to provide a similar level of protection as conventional security bollards without requiring complex electrical, hydraulic, or pneumatic systems. For example, the security bollard system 100 described herein may be capable of stopping a moving vehicle with the same momentum as conventional security bollards. The security bollard system 100, comprising at least one bollard assembly 102, avoids the need for electrical, hydraulic, or pneumatic systems, and each bollard assembly 102 may be configured to move between a raised position and a lowered position, and impede vehicle motion when in the raised position. In some embodiments, the security bollard system 100 comprises at least two bollard assemblies 102.

Figure 10:
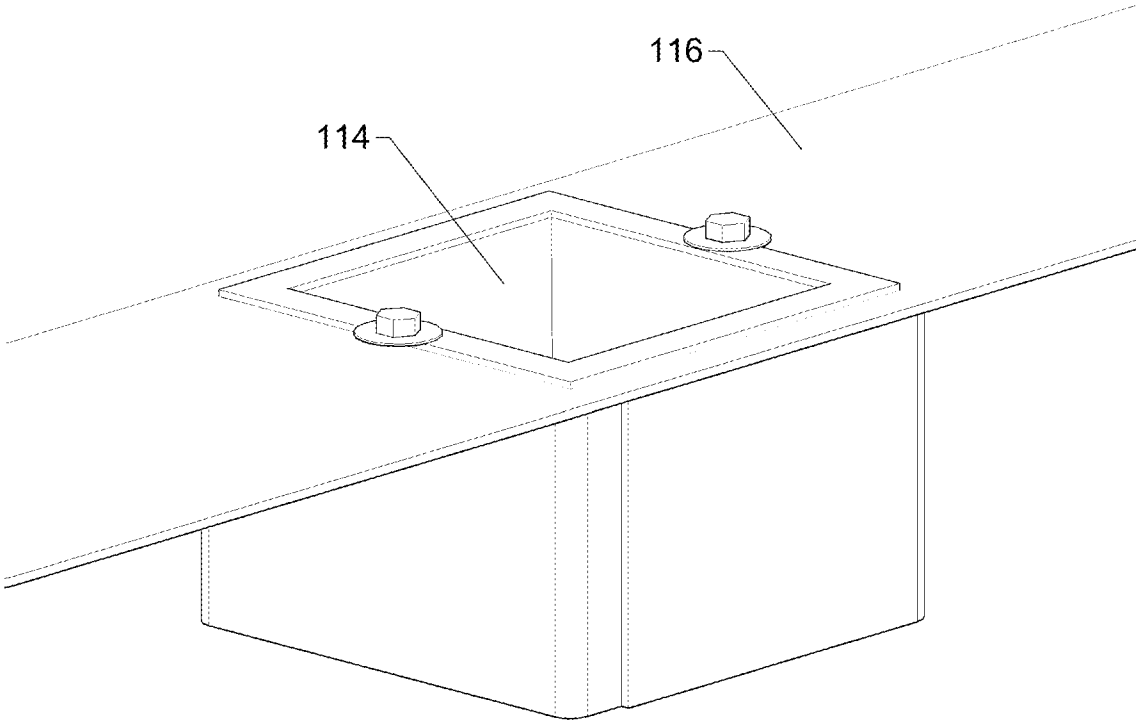
FIG. 10 is a close-up view of a drain hole in the housing of the security bollard system shown in FIG. 1.

As shown in FIGS. 1-8, the security bollard system 100 may comprise a housing 104 that is configured to house the bollard assemblies 102. The housing 104 may have an interior 106. Additionally, the housing 104 may have a top surface 108 with at least one opening 110 extending through the top surface 108 into the interior 106. At least one cover panel 112 may be configured to cover the at least one opening 110. The cover panel 112 may be hingedly attached to the housing 104, or may be a removable panel that sits on top of the housing 104. Other methods of coupling the cover panel 112 to the housing 104 may also be implemented. The security bollard system 100 may have at least one drain hole 114 through a bottom 116 of the housing 104 (see FIG. 10). The drain hole 114 is configured to drain fluid such as water out of the housing 104, thus preventing large of amounts of fluid from collecting in the housing 104. This is helpful in particular because the housing 104 is frequently installed below ground level, with the top surface 108 of the housing 104 at ground level, and thus may fill up with rainwater and the like.

Each of the bollard assemblies 102 may comprise a bollard 118, an upper stop 120, a locking tab 122, and/or a locking pin 124. The bollard 118 may have an outward appearance that is similar to conventional security bollards, and thus may have an axis extending perpendicular to a cross section of the bollard 118. The bollard 118 may have a circular cross section, and therefore be cylindrical in shape, or may have a rectangular cross section and be box shaped. Other cross sections may also be implemented. The bollard 118 is designed to resist failure when a load is applied to the bollard 118 in a direction perpendicular to the axis of the bollard 118, such as that applied by a vehicle when it makes contact with the bollard 118. Design decisions such as the shape and size of the cross section, as well as the materials used to form the bollard 118 and the internal construction of the bollard 118 may be influenced by this design objective. Other design decisions may also be made to improve the ability of the bollard 118 to resist failure.

The bollard 118 may be rotatably coupled to the interior 106 of the housing 104. A bearing 126 may be used to join the bollard 118 to the housing 104 to decrease the friction created when the bollard 118 rotates. As mentioned above, the bollard 118 may be manually rotatable between a lowered position (see FIGS. 2, 6, and 8) and a raised position (see FIGS. 1, 5, and 7) to selectively allow a vehicle to pass over the security bollard system 100. Adjacent bollard assemblies 102 may be separated sufficiently to allow the bollards 118 to rotate to the lowered position without adjacent bollards 118 running into each other. Bollards 118 of adjacent bollard assemblies 102 may rotate independent of each other.

Figure 2:
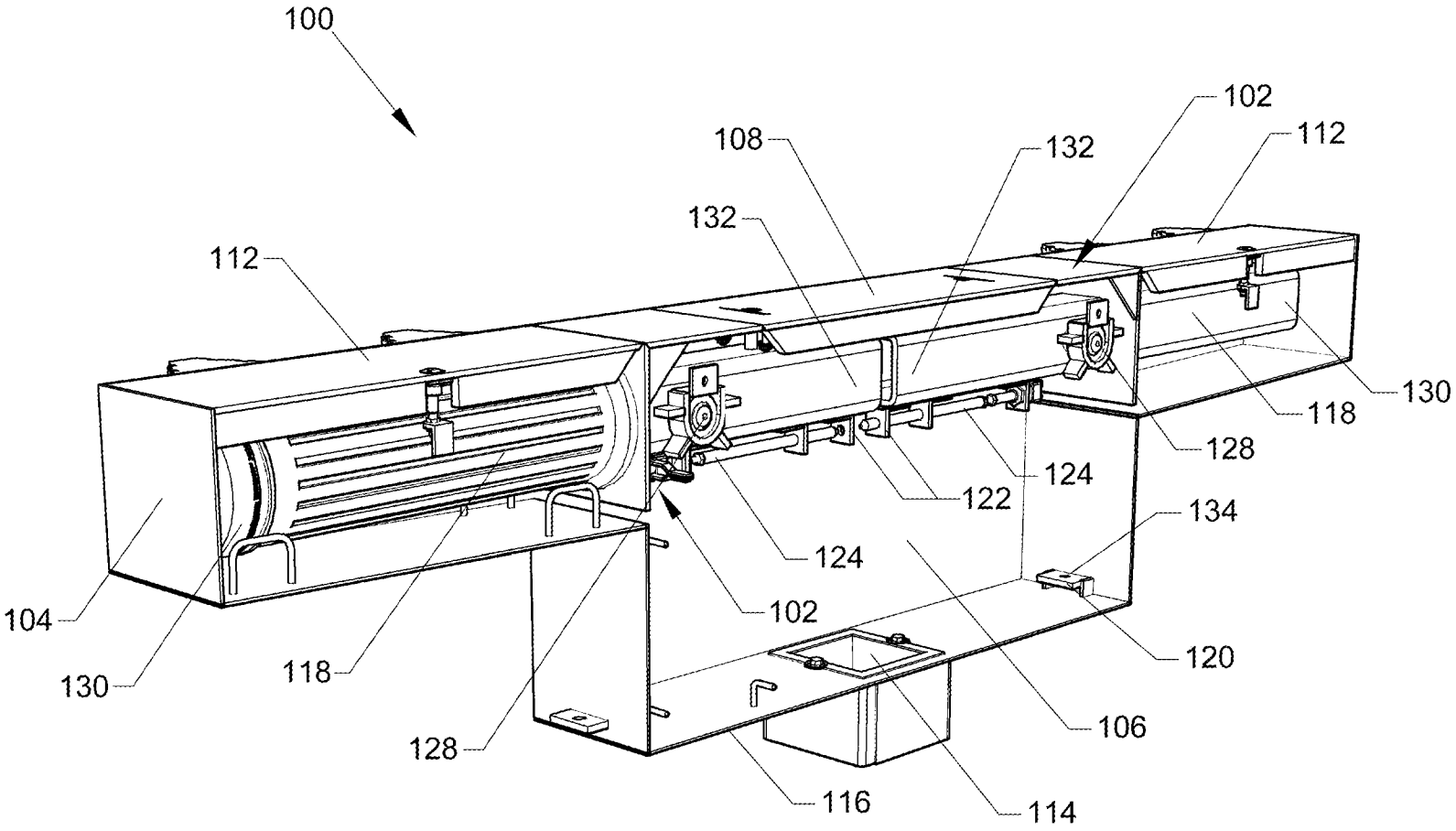
FIG. 2 is a perspective view of the security bollard system shown in FIG. 1 in the lowered position.
Figure 3:
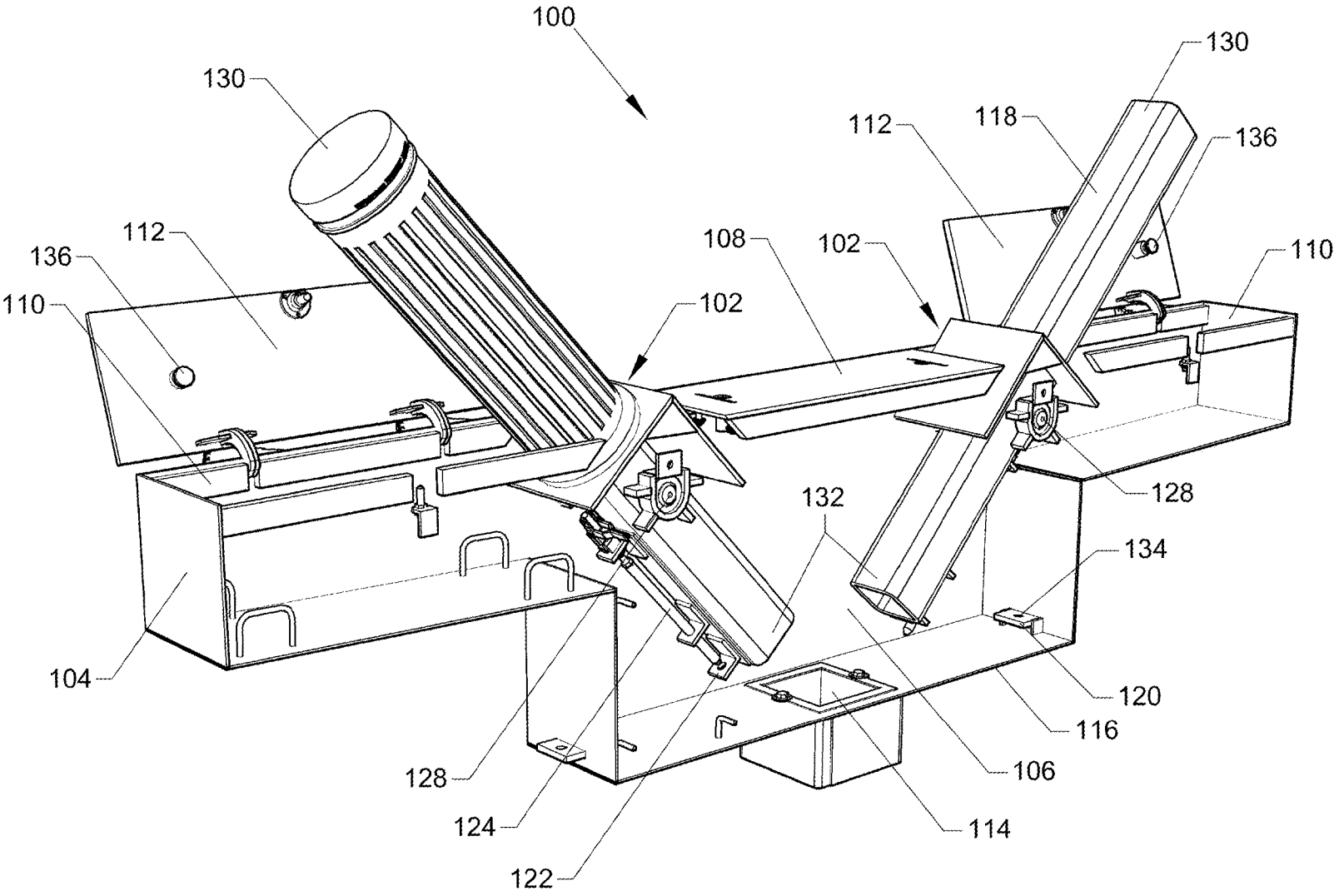
FIG. 3 is a perspective view of the security bollard system shown in FIG. 1 in a position between the raised position and the lowered position.
Figure 4:
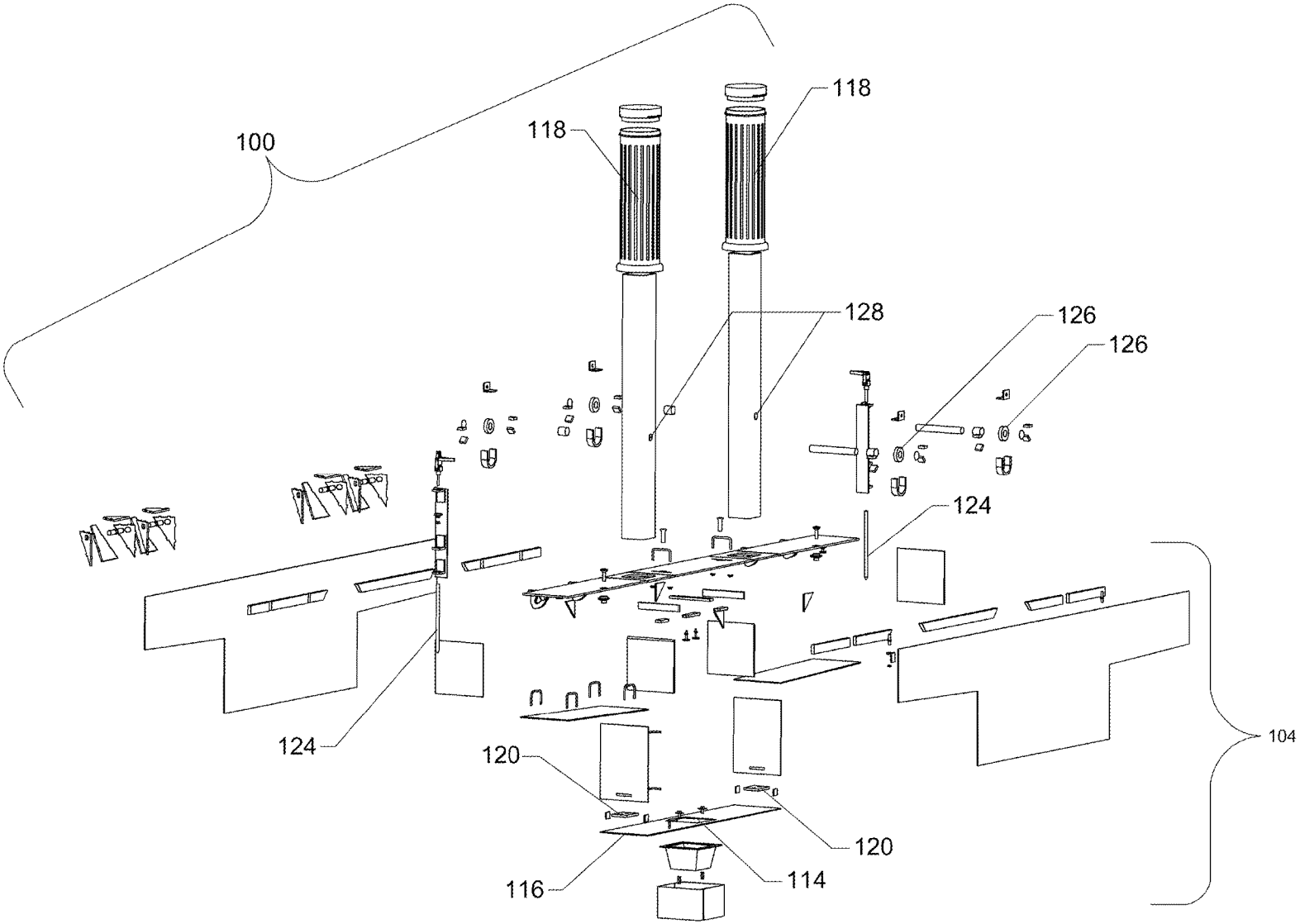
FIG. 4 is an exploded view of the security bollard system shown in FIG. 1.
Figure 5:
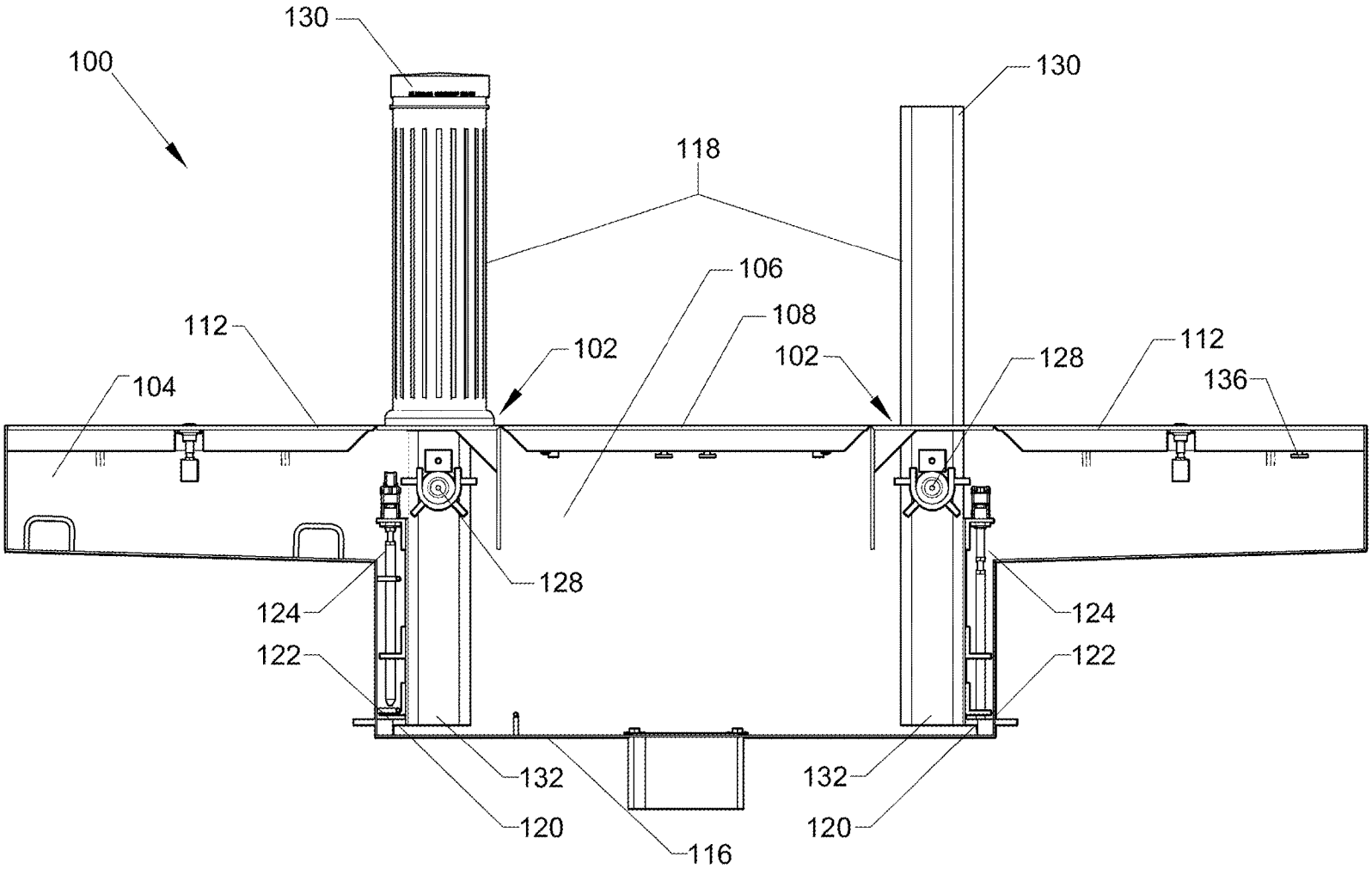
FIG. 5 is a side view of the security bollard system shown in FIG. 1 with the side of the housing removed to expose the interior of the housing and with the bollards in the raised position.
Figure 6:
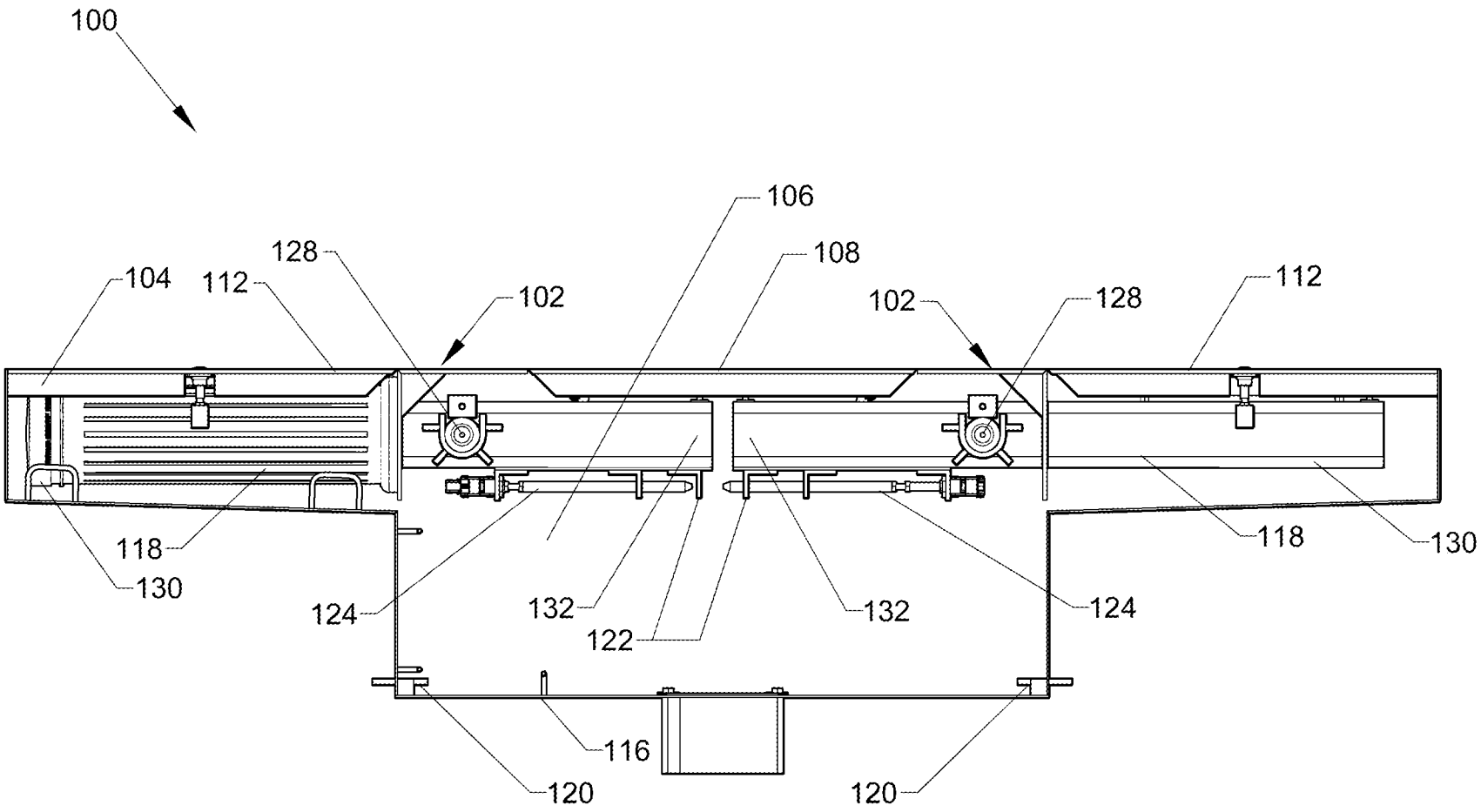
FIG. 6 is a side view of the security bollard system shown in FIG. 1 with the bollards in the lowered position.
Figure 7:
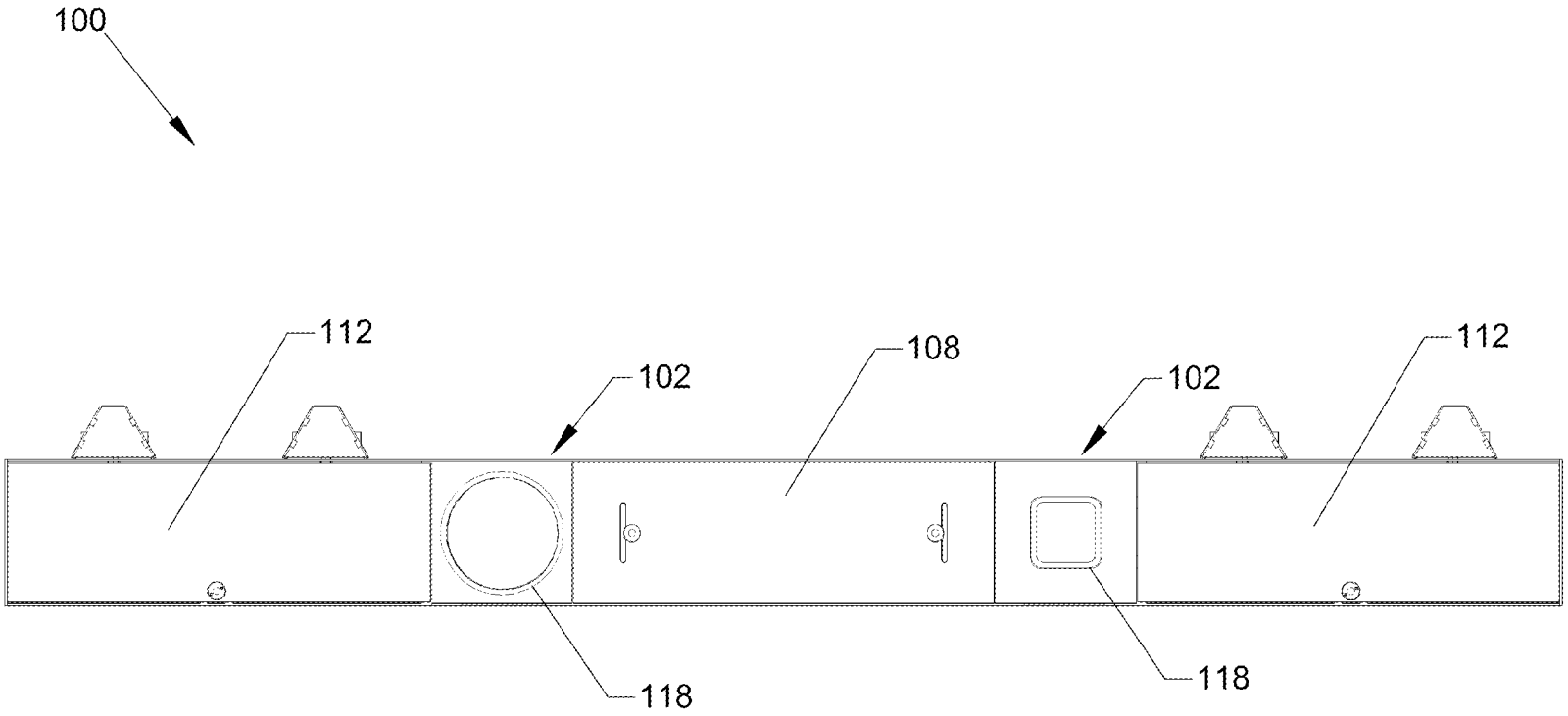
FIG. 7 is a top view of the security bollard system shown in FIG. 1 with the bollards in the raised position.
Figure 8:
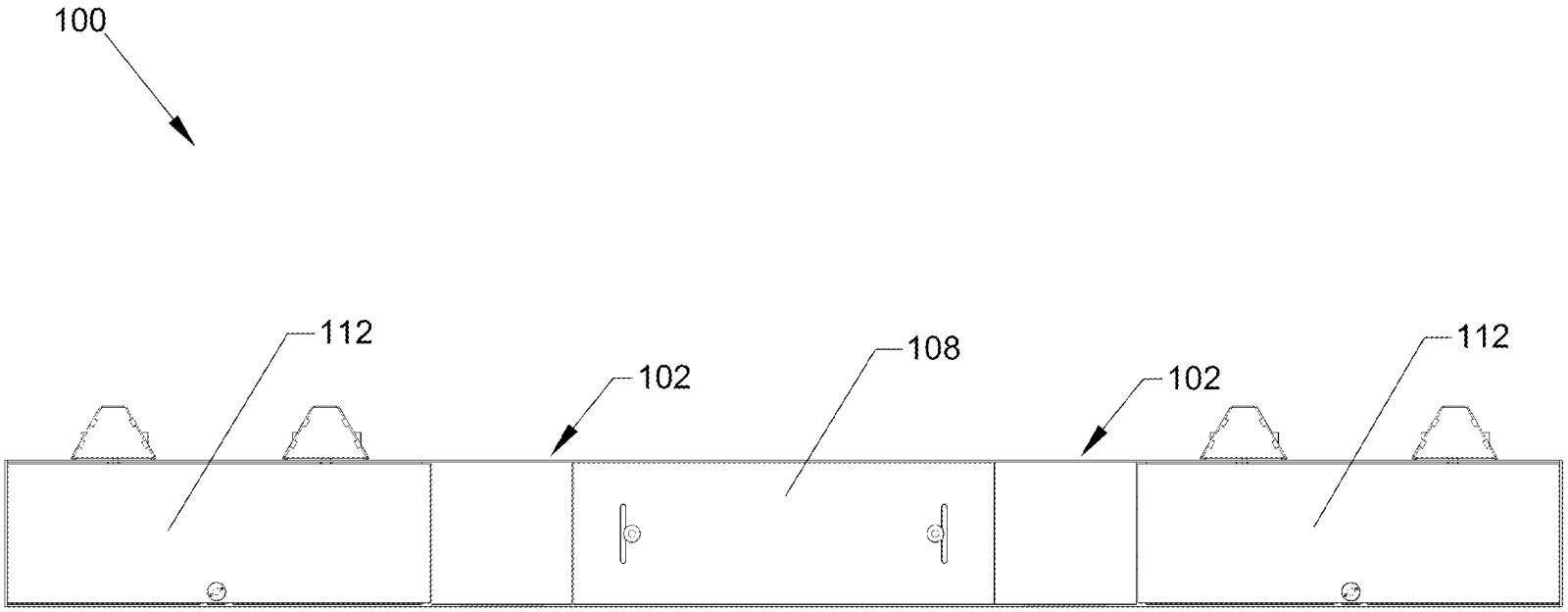
FIG. 8 is a top view of the security bollard system shown in FIG. 1 with the bollards in the lowered position.

As shown in FIG. 2, when in the lowered position, the bollard 118 may be oriented to allow a vehicle to pass over the security bollard system 100, and as shown in FIG. 1, when in the raised position, the bollard 118 may be oriented to impede the vehicle from passing over the security bollard system 100 by extending above ground level into the vehicle's path of travel. In some embodiments, when in the lowered position, the bollards 118 may be positioned in the interior 106 of the housing 104 and/or may be oriented parallel with the top surface 108 of the housing 104. This allows the bollard 118 to be lowered below the surface of the pavement, road, or other driving surface so that the vehicle can easily pass over the security bollard system 100. When in the raised position, the bollard 118 may extend up through the at least one opening 110 and/or may be perpendicular to the top surface 108 of the housing 104, thus extending above ground level and impeding the vehicle from passing over the security bollard system 100. In some embodiments, the bollard 118 is not parallel with the top surface 108 when in the lowered position, but instead is in another angled orientation in which the bollard 118 still allows the vehicle to pass over the security bollard system 100. Similarly, in some embodiments, the bollard 118 is not perpendicular to the top surface 108 when in the raised position, but instead is in another angled orientation in which the bollard 118 still impedes the vehicle from passing over the security bollard system 100.

Each bollard 118 has a pivot point 128 about which the bollard 118 rotates. Each bollard 118 rotates about an axis that extends in a first direction and is configured to impede vehicle motion in the first direction. In other words, in particular implementations, the bollards 118 are configured to impede vehicles moving in a direction perpendicular to the plane of rotation of the bollards 118. The pivot point 128 is positioned along the bollard 118 to facilitate manually moving the bollard 118 from the lowered position to the raised position. While conventional bollards are too heavy to manually lift or lower due to the bollards being designed to resist failure, the bollards 118 disclosed herein are coupled to the housing 104 in a way that enables users to manually move the bollards 118 between the lowered position and the raised position, despite the heavy height of each bollard 118. For example, the pivot point 128 may be positioned to balance the bollard 118 about the pivot point 128. In some embodiments, this means that the pivot point 128 divides the bollard 118 into two portions, where each portion contains an equal amount of mass. In other embodiments, each portion has different amounts of mass, but the distance of the center of mass from the pivot point of each portion is such that the bollard 118 is balanced despite the differing amounts of mass. Additionally, the bollards 118 need not be perfectly balanced to be considered balanced for the purposes of this disclosure. Instead, each bollard 118 may be biased to rotate to a particular orientation due to an imbalance between the two portions created by the pivot point 128. In such embodiments, the bollards 118 are still balanced as long as the bollards 118 can be manually rotated between the lowered position and the raised position. The pivot point 128 may be positioned to limit a torque required to rotate the bollard 118 about the pivot point 128. The torque required to rotate the bollard 118 about the pivot point 128 may be limited to, or may be less than or equal to, 5 ft-lbs., 10 ft-lbs., 15 ft-lbs., 25 ft-lbs., 50 ft-lbs., 75 ft-lbs., 100 ft-lbs., 150 ft-lbs., or 300 ft-lbs. Such torques can be applied manually to the bollard 118 by exerting a force at some point along the bollard 118, especially at an end of the bollard 118.

The pivot point 128 may be located in the interior 106 of the housing 104 near the top surface 108 of the housing 104. This allows the bollard 118 to rotate about the pivot point 128 to the lowered position and be positioned in the interior 106 of the housing 104. Due to the balanced nature of the bollards 118 as described above, when the bollard 118 is rotated to the raised position, a first end 130 of the bollard 118 is positioned above the pivot point 128 outside of the housing 104 and a second end 132 of the bollard 118 is positioned below the pivot point 128 in the interior 106 of the housing 104. A distance measured from the pivot point 128 to the first end 130 may be substantially similar to a distance measured from the pivot point 128 to the second end 132. A difference between the distance from the pivot point 128 to the first end 130 and the distance from the pivot point 128 to the second end 132 may be less than or equal to 10 inches, 15 inches, 20 inches, or 30 inches, or may be between 10 inches and 15 inches, 10 inches and 20 inches, or 5 inches and 15 inches. Other distances may be used that lead to different differences than are listed here. Similarly, a ratio between the distance from the pivot point 128 to the first end 130 and the distance from the pivot point 128 to the second end 132 may be less than or equal to 3:1, 2:1, or 1.5:1. Each bollard 118 may rotate in a direction opposite from each adjacent bollard 118. Thus, in an embodiment having two bollard assemblies 102, the two bollards 118 may rotate within the same plane of rotation, but in opposite directions.

Figure 9:
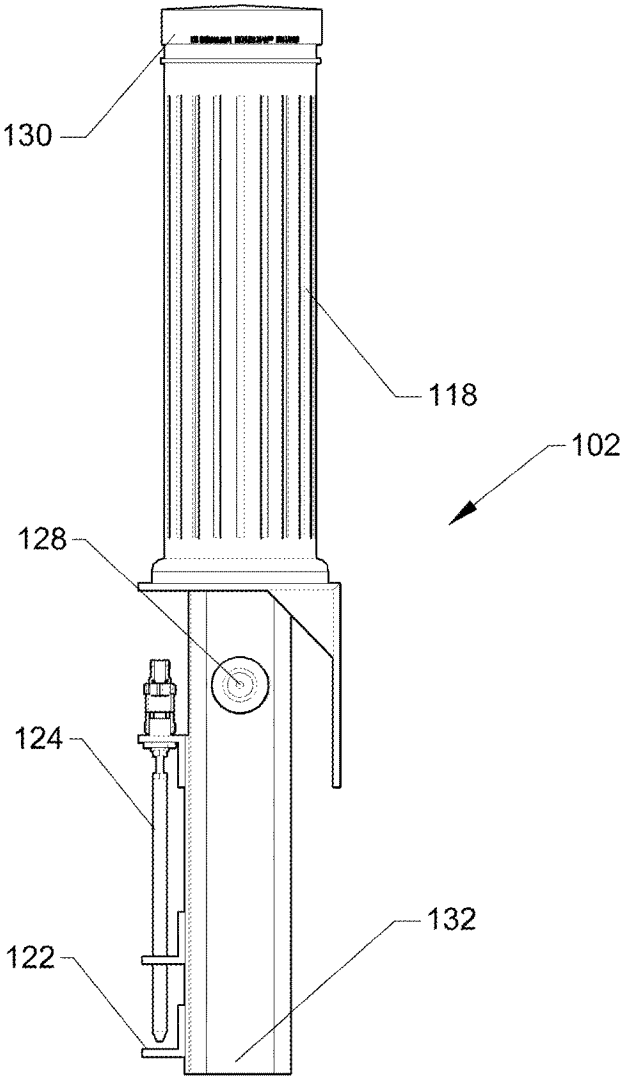
FIG. 9 is a close-up view of one of the bollards of the security bollard system shown in FIG. 1, showing the locking tab.

The upper stop 120 of each bollard assembly 102 is positioned within the interior 106 of the housing 104 and is positioned to contact the bollard 118 when the bollard 118 is in the raised position. The upper stop 120 may function as a limit to the rotation of the bollard 118 in one direction. The upper stop 120 may be positioned adjacent the top surface 108 of the housing 104, adjacent the bottom 116 of the housing 104, or anywhere else within the housing 104. As shown in FIG. 9, the locking tab 122 is coupled to and extends away from the bollard 118, and has a locking aperture 134. The locking aperture 134 is configured to align with the upper stop 120 when the bollard 118 is in the raised position. This allows the locking pin 124 to engage with the upper stop 120 and the locking aperture 134 of the locking tab 122 to couple the locking tab 122 to the upper stop 120 and lock the bollard 118 in the raised position. In this way, the bollard 118 can be maintained in the raised position without manual interference until the user desires to lower the bollard 118, at which point the user can remove the locking pin 124 and manually lower the bollard 118 to the lowered position.

Each bollard assembly 102 may also comprise a protrusion 136 coupled to the cover panel 112. The protrusion 136 extends away from the cover panel 112 and is configured to hold the bollard 118 in the lowered position when the cover panel 112 is positioned to cover the opening 110. The protrusion 136 may be a platform, and may have a rubber surface to protect the bollard 118 from scratches and improve the connection between the protrusion 136 and the bollard 118.

As has been mentioned above, the security bollard system 100 described herein is able to operate without any electricity because it can be manually raised to the raised position and lowered to the lowered position. Additionally, because the bollard 118 is balanced above the pivot point or otherwise configured to make the bollard 118 manually rotatable, a single person can move the bollard 118 between the raised and lowered positions with minimal effort.

It will be understood that implementations of a security bollard system are not limited to the specific assemblies, devices and components disclosed in this document, as virtually any assemblies, devices and components consistent with the intended operation of a security bollard system may be used. Accordingly, for example, although particular security bollard systems, and other assemblies, devices and components are disclosed, such may include any shape, size, style, type, model, version, class, measurement, concentration, material, weight, quantity, and/or the like consistent with the intended operation of security bollard systems. Implementations are not limited to uses of any specific assemblies, devices and components; provided that the assemblies, devices and components selected are consistent with the intended operation of a security bollard system.

Accordingly, the components defining any security bollard system may be formed of any of many different types of materials or combinations thereof that can readily be formed into shaped objects provided that the materials selected are consistent with the intended operation of a security bollard system. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, nickel, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof. In instances where a part, component, feature, or element is governed by a standard, rule, code, or other requirement, the part may be made in accordance with, and to comply under such standard, rule, code, or other requirement.

Various security bollard systems may be manufactured using conventional procedures as added to and improved upon through the procedures described here. Some components defining a security bollard system may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that methods for manufacturing or assembling security bollard systems are not limited to the specific order of steps as disclosed in this document. Any steps or sequence of steps of the assembly of a security bollard system indicated herein are given as examples of possible steps or sequence of steps and not as limitations, since various assembly processes and sequences of steps may be used to assemble security bollard systems.

The implementations of a security bollard system described are by way of example or explanation and not by way of limitation. Rather, any description relating to the foregoing is for the exemplary purposes of this disclosure, and implementations may also be used with similar results for a variety of other applications employing a security bollard system.

What is claimed is:

1. A security bollard system comprising:

a housing having an interior and a top surface with at least one opening through the top surface into the interior and at least one cover panel configured to cover the at least one opening; and at least two bollard assemblies positioned within the housing, each bollard assembly of the at least two bollard assemblies comprising:

a bollard rotatably coupled to the interior of the housing through a bearing, the bollard manually rotatable between a lowered position and a raised position, wherein when in the lowered position, the bollard is positioned in the interior of the housing and oriented parallel with the top surface of the housing and when in the raised position, the bollard extends up through the at least one opening perpendicular to the top surface of the housing;

an upper stop positioned within the interior of the housing to contact the bollard when the bollard is in the raised position;

a locking tab extending away from the bollard and having a locking aperture, the locking aperture configured to align with the upper stop when the bollard is in the raised position; and a locking pin configured to engage with the upper stop and the locking aperture to couple the locking tab to the upper stop and lock the bollard in the raised position;

wherein the bollard has a pivot point about which the bollard rotates that is positioned to balance the bollard about the pivot point and limit a torque required to rotate the bollard about the pivot point;

wherein each bollard of the at least two bollard assemblies rotates in a direction opposite from each adjacent bollard of the at least two bollard assemblies;

wherein each bollard is configured to rotate about an axis extending in a first direction and impede vehicle motion in the first direction; and wherein each bollard is configured to be moved between the lowered position and the raised position manually.

2. The security bollard system of claim 1, further comprising at least one drain hole through a bottom of the housing, the at least one drain hole configured to drain fluid out of the housing.

3. The security bollard system of claim 1, each bollard assembly further comprising a protrusion coupled to and extending away from the at least one cover panel and configured to hold the bollard in the lowered position when the at least one cover panel is positioned to cover the at least one opening.

4. A security bollard system comprising:

a housing having an interior and a top surface with at least one opening through the top surface into the interior; and at least one bollard assembly positioned within the housing, each of the at least one bollard assembly comprising:

a bollard rotatably coupled to the interior of the housing, the bollard rotatable between a lowered position and a raised position, wherein when in the lowered position, the bollard is positioned in the interior of the housing and when in the raised position, the bollard extends up through the at least one opening;

an upper stop positioned within the interior of the housing to contact the bollard when the bollard is in the raised position;

a locking tab extending away from the bollard, the locking tab configured to align with the upper stop when the bollard is in the raised position; and a locking pin configured to engage with the upper stop and the locking tab to couple the locking tab to the upper stop and lock the bollard in the raised position;

wherein the bollard of each of the at least one bollard assembly has a pivot point about which the bollard rotates that is positioned to balance the bollard about the pivot point; and wherein the bollard of each of the at least one bollard assembly is configured to rotate about an axis extending in a first direction and impede vehicle motion in the first direction.

5. The security bollard system of claim 4, wherein the pivot point is positioned to limit a torque required to rotate the bollard about the pivot point.

6. The security bollard system of claim 4, wherein the bollard is rotatably coupled to the interior of the housing through a bearing.

7. The security bollard system of claim 4, wherein when the bollard is in the lowered position, the bollard is oriented parallel with the top surface of the housing and when the bollard is in the raised position, the bollard is perpendicular to the top surface of the housing.

8. The security bollard system of claim 4, the locking tab having a locking aperture, wherein the locking pin is configured to engage with the upper stop and the locking aperture to lock the bollard in the raised position.

9. The security bollard system of claim 4, wherein the bollard is configured to be moved between the lowered position and the raised position manually.

10. The security bollard system of claim 4, wherein the at least one bollard assembly comprises at least a first bollard assembly and at least an adjacent bollard assembly, and wherein the bollard of the first bollard assembly rotates in a direction opposite from the bollard of the adjacent bollard assembly.

11. The security bollard system of claim 4, further comprising at least one drain hole through a bottom of the housing, the at least one drain hole configured to drain fluid out of the housing.

12. A security bollard system comprising:

at least one bollard assembly, each bollard assembly of the at least one bollard assembly comprising:

a bollard rotatable between a lowered position and a raised position, wherein when in the lowered position, the bollard is oriented to allow a vehicle to pass over the security bollard system and when in the raised position, the bollard is oriented to impede the vehicle from passing over the security bollard system; and a locking assembly comprising a locking tab extending away from the bollard and a locking pin configured to engage with the locking tab and lock the bollard in the raised position:

wherein the bollard is configured to rotate about an axis extending in a first direction and impede vehicle motion in the first direction when the bollard is in the raised position.

13. The security bollard system of claim 12, further comprising a housing having an interior and a top surface with at least one opening through the top surface of the interior, wherein the at least one bollard assembly is positioned within the housing.

14. The security bollard system of claim 13, wherein when in the lowered position, the bollard is positioned in the interior of the housing and when in the raised position, the bollard extends up through the at least one opening.

15. The security bollard system of claim 12, the locking assembly comprising an upper stop positioned to contact the bollard when the bollard is in the raised position.

16. The security bollard system of claim 15, wherein the locking tab configured to align with the upper stop when the bollard is in the raised position, and a locking pin configured to engage with the upper stop and the locking tab to couple the locking tab to the upper stop and lock the bollard in the raised position.

17. The security bollard system of claim 12, wherein the bollard has a pivot point about which the bollard rotates that is positioned to balance the bollard about the pivot point.

18. The security bollard system of claim 12, wherein the bollard is configured to be moved between the lowered position and the raised position manually.

19. The security bollard system of claim 12, wherein the at least one bollard assembly comprises at least a first bollard assembly and at least an adjacent bollard assembly, and wherein the bollard of the first bollard assembly rotates in a direction opposite from the bollard of the adjacent bollard assembly.

* * * * *